US010461435B2

(12) United States Patent
Moore

(10) Patent No.: US 10,461,435 B2
(45) Date of Patent: Oct. 29, 2019

(54) MULTIPLE TUNED FRESNEL ZONE PLATE REFLECTOR ANTENNA

(71) Applicant: Tionesta, LLC, San Antonio, TX (US)

(72) Inventor: Brad David Moore, Boerne, TX (US)

(73) Assignee: TIONESTA, LLC, Austin, TX (US)

( * ) Notice: Subject to any disclaimer, the term of this patent is extended or adjusted under 35 U.S.C. 154(b) by 226 days.

(21) Appl. No.: 15/393,474

(22) Filed: Dec. 29, 2016

(65) Prior Publication Data

US 2018/0191078 A1 Jul. 5, 2018

(51) Int. Cl.

| | |
|---|---|
| ***H01Q 19/06*** | (2006.01) |
| ***H01Q 15/14*** | (2006.01) |
| ***H01Q 15/16*** | (2006.01) |
| ***H01Q 21/30*** | (2006.01) |
| ***H01Q 1/28*** | (2006.01) |
| *H01Q 19/13* | (2006.01) |
| *H01Q 5/30* | (2015.01) |

(52) U.S. Cl.

CPC ..... *H01Q 15/147* (2013.01); *H01Q 1/288* (2013.01); *H01Q 15/16* (2013.01); *H01Q 15/166* (2013.01); *H01Q 19/065* (2013.01); *H01Q 21/30* (2013.01); *H01Q 5/30* (2015.01); *H01Q 19/132* (2013.01)

(58) Field of Classification Search

CPC ..... H01Q 15/147; H01Q 1/288; H01Q 15/16; H01Q 19/065; H01Q 15/166; H01Q 21/30; H01Q 5/30; H01Q 19/132

See application file for complete search history.

(56) References Cited

U.S. PATENT DOCUMENTS

| | | | | |
|---|---|---|---|---|
| 5,257,132 | A | 10/1993 | Ceglio et al. | |
| 7,025,456 | B2 * | 4/2006 | Morris | A61F 2/1613 351/159.44 |
| 7,156,516 | B2 * | 1/2007 | Morris | A61F 2/1613 351/159.44 |
| 2004/0233122 | A1 * | 11/2004 | Espenscheid | H01Q 15/14 343/912 |
| 2009/0243955 | A1 * | 10/2009 | Legare | H01Q 1/08 343/882 |
| 2016/0306079 | A1 | 10/2016 | Arbabi et al. | |

FOREIGN PATENT DOCUMENTS

| | | |
|---|---|---|
| EP | 1020953 A2 | 7/2000 |

OTHER PUBLICATIONS

Tayebi, Abdelhamid et al, "Broadband design of a low-profile reflector antenna", The Institution of Engineering and Technology, 2013, pp. 630-634.

Wiltse, James et al, "The Fresnel Zone Plate Antenna", Microwave Journal, Jan. 1991, pp. 101-114.

(Continued)

*Primary Examiner* — Hai V Tran
*Assistant Examiner* — Awat M Salih
(74) *Attorney, Agent, or Firm* — Osha Liang LLP

(57) ABSTRACT

The invention is a dual and stagger-tuned 8-step FZP antenna for use in VSAT operations. The preferred embodiment achieves the desired antenna gain at the RX band (centered at 11.95 GHz) and the TX band (centered at 14.25 GHz). The flexible antenna is 1-meter diameter and less than 1-inch thick, allowing it to be folded to the size of a tissue box for easy storage and transportability.

14 Claims, 9 Drawing Sheets

(56) References Cited

OTHER PUBLICATIONS

The Extended European Search Report issued in corresponding European Patent Application No. 17211143.7-1205, dated Apr. 13, 2018 (9 pages).

Malliot H. A. "Zone plate reflector antennas for applications in space", Aerospace Applications Conference, 1994, Proceedings., 1994 IEEE Vail, CO, USA Feb. 5-12 1, New York, NY, USA, IEEE, Feb. 5, 1994 (Feb. 5, 1994), pp. 295-311, XP010120942, DOI: 10.1109/Aero. 1994.291189, ISBN: 978-0-7803-1831-1 (17 pages).

* cited by examiner

*Schematic profile of an FZP with five zones and four steps and schematic profile of the equivalent modified FZR*

MULTIPLE TUNED FRESNEL ZONE PLATE REFLECTOR ANTENNA

BACKGROUND OF THE INVENTION

1. Field of the Invention

The present invention is directed to a new category of portable Ku-band satellite antenna that offers lighter weight, reduced storage volume, and similar link performance compared to existing designs. To reduce the weight and storage volume, the invention's reflector is flat and assembled like puzzle pieces.

2. Description of Related Art

Ku-band very small aperture terminals (VSATs) are used extensively globally for transmitting and receiving narrowband and broadband data. VSAT antennas are often over 1 meter in diameter and heavy, inhibiting the ease of portability and storage. For these reasons, there is a demand for a lighter weight and reduced storage volume antenna, without any reduction in link performance.

Fresnel zoneplate (FZP) antennas are advantageous to traditional antennas because the surface has a phase shifting property that allows the antennas to be constructed flat. The FZP is also relatively inexpensive to manufacture and install. The transportability and high gain of FZPs make them ideal for use in VSATs. The present invention uses multiple steps within each Fresnel zone to maximize gain and antenna efficiency.

It is known in the art, that the phase step directly impacts FZP efficiency. A 2-step FZP has a phase correction of 180-degrees. This translates into 40% efficiency, which is 4 dB less gain. A large-aperture (40λ+) implementation of this was modeled in Ku-band and the bandwidth found to be approximately 9% regardless of the number of minor steps (2, 4, and 8). The efficiency of a stepped reflector design improves with the number of minor steps per Fresnel zone ring.

An FZP reflector has Fresnel zone rings divided into minor steps. At the outer radius of each zone ring, there is a major step that occurs from maximum thickness to minimum thickness and is equal to an odd multiple of (λ)(90°) at the center frequency of the design, where λ is the wavelength. The minor step is the incremental zone height between major steps. A 2-step FZP only has two zone heights, whereas an 8-step FZP has eight. The larger the number of steps, the more closely the Fresnel zone rings approaches a section of a smooth parabola and the more efficient it becomes. The minor step size determines the zone correction. The coarser the step size, the more phase error is introduced by each zone ring of the FZP. The gain efficiencies are summarized in the following table:

Summary of Antenna Performances

| ANTENNA | RELATIVE GAIN @12.2 GHz | BAND WIDTH (−1 DB POINTS) |
|---|---|---|
| PRIME FOCUS PARABOLIC DISH | 0 DB (REFERENCE) | WIDEBAND |
| FZP PRIME FOCUS 2-STEP | −4.00 DB | 8.02% (1 GHz) |

-continued

| ANTENNA | RELATIVE GAIN @12.2 GHz | BAND WIDTH (−1 DB POINTS) |
|---|---|---|
| FZP PRIME FOCUS 4-STEP | −0.91 DB | 9.0% (1.1 GHz) |
| FZP PRIME FOCUS 8-STEP | −0.22 DB | 9.0% (1.1 GHz) |

FZP reflectors are not limited to a Fresnel zone major step of 90° (λ/4). However, the major step must provide 180° of effective phase change for the bounce paths to sum in phase at the feed horn. Therefore, the major step can be (n*90), where n=1, 3, 5, 7 . . . , but any value of n greater than 1 results in a thicker and heavier structure.

Recently, a new technology based on slight deformations on a flat metallic surface was used to obtain a geometric model of a flat FZP reflector antenna. This approach uses smoothed segments of a parabolic curve instead of flat steps. Their implementation consists of an 11.8 GHz antenna only 3 zones×2 zones in extent (280 mm×210 mm, or 11λ×8λ). The bandwidth attained by this approach is 17.6% but this is likely because there are only a few Fresnel rings in the design.

The present invention produces greater antenna gains than what is known in the art. Further the FZP reflectors in the prior art are single-tuned and can cover a standard 500-MHz wide band segment at Ku-band. However, conducting VSAT operations requires a multiple-tuned FZP. VSATs require that the antenna function over two separate 500-MHz band segments: one for receiving (RX) and one for transmitting (TX). The current invention solves this problem by designing a dual-tuned (stagger-tuned) FZP, allowing the antenna to have gain peaks at both desired frequencies.

SUMMARY OF THE INVENTION

The present invention is a new category of portable Fresnel zone plate reflector antenna that offers lighter weight, reduced storage volume, and similar link performance compared to existing non-portable designs. To reduce the weight and storage volume, the invention's antenna reflector is flexible or foldable and can be assembled like puzzle pieces rather than rigid segmented reflector shapes.

The preferred embodiment of the current invention is an 8-step dual-tuned (stagger-tuned) FZP antenna with the feed point centered. Even with a diameter of 1-meter, the innovations of the present invention keep the thickness under 1-inch and additionally allows the antenna to be folded to approximately the size of a tissue box when stored and transported. The stagger-tuned FZP divides the FZP into 8 pie-shaped sections of 45-degrees each, alternating low and high band patterns to maintain radial symmetry, as further described below.

The invention achieves the desired gain at the RX band (centered at 11.95 GHz) and the TX band (centered at 14.25 GHz), overcoming the limitations of single-tuned antennas in the art. The FZP can be divided into other numbers of "pie" pieces and achieve the similar results as further described below. It is not necessary that the proportion of FZP aperture allocated to low and high bands be 50%-50%. When the proportion is changed, the angles of "pie" pieces must be altered to balance the RX and TX gain values.

Another alternate embodiment uses an offset feed design instead of prime focus but uses the same method of a stagger-tuned FZP reflectors. The offset feed horn design provides an advantage because less black body noise is coupled into the feed horn, thus improving signal to noise ratio of the incoming signal. Alternate embodiments of multiple-tuned designs are not limited to pie-shaped segments or a perfect circular outline. For example, a hexagonal implementation of the invention will also work. Additionally, three or more frequency channels can be implemented.

BRIEF DESCRIPTION OF THE DRAWINGS

A better understanding of the present invention may be had from the drawings as follows.

DETAILED DESCRIPTION OF THE PREFERRED EMBODIMENTS

As previously stated, the present invention is directed to a design concept for a new category of portable Ku-band satellite antenna that will offer lighter weight, reduced storage volume, and similar link performance compared to existing portable designs.

Figure 1:
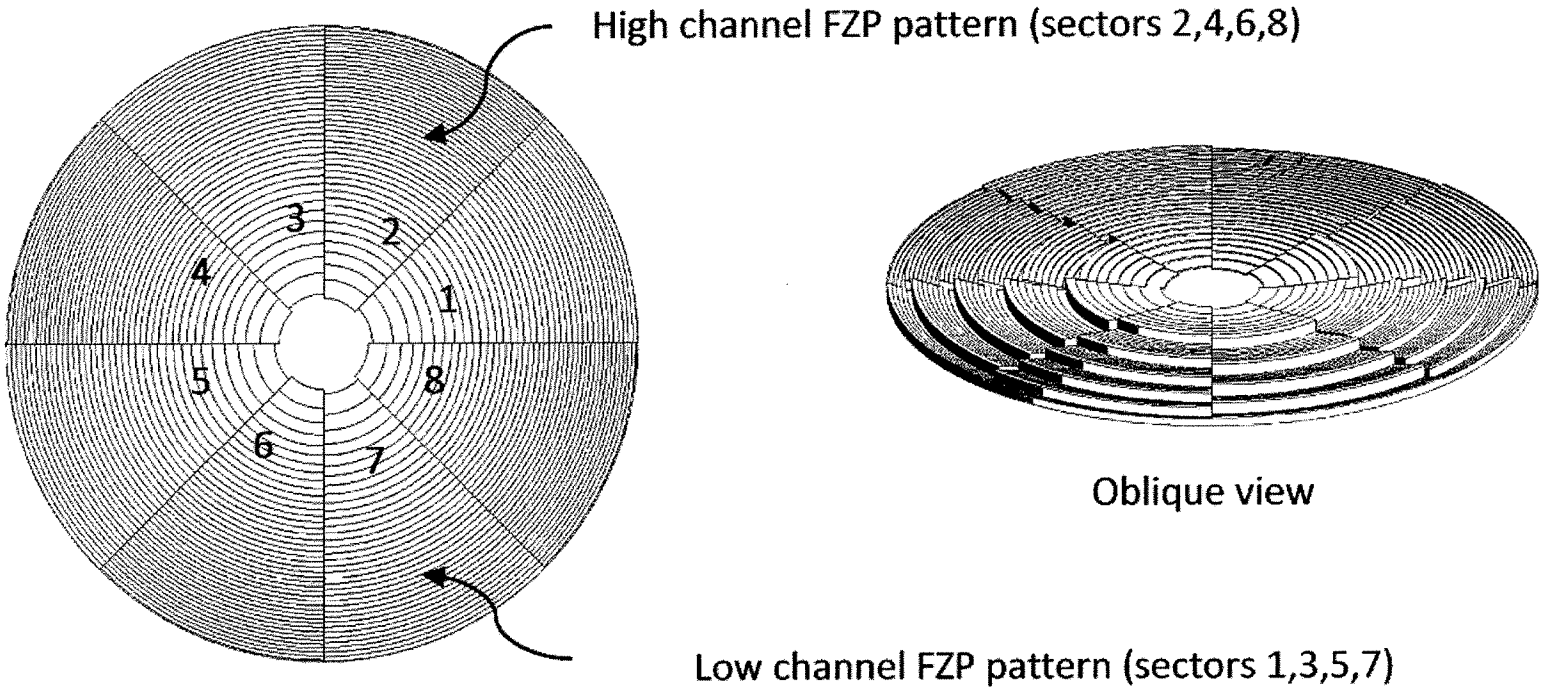
FIG. 1 is a diagram of the preferred embodiment of the present invention, a dual-tuned (stagger-tuned) 8-step VSAT design.

FIG. 1 is a diagram of the preferred embodiment of the present invention, a dual-tuned (stagger-tuned) VSAT design with half of the antenna aperture consisting of an FZP design centered at 11.95 GHz (center of the RX band), and the remaining half of the antenna aperture consisting of an FZP design centered at 14.25 GHz (center of the TX band). The feed point (feed horn) is centered and an 8-step FZP pattern is used. The first implementation of the stagger-tuning design consists of dividing the circle into eight equal "pie" sections of 45-degrees each (8 slices of pie). This implementation is chosen so that the gain response from a dual-polarized feed horn will be axially symmetric no matter the rotational orientation of the FZP reflector.

Figure 2:
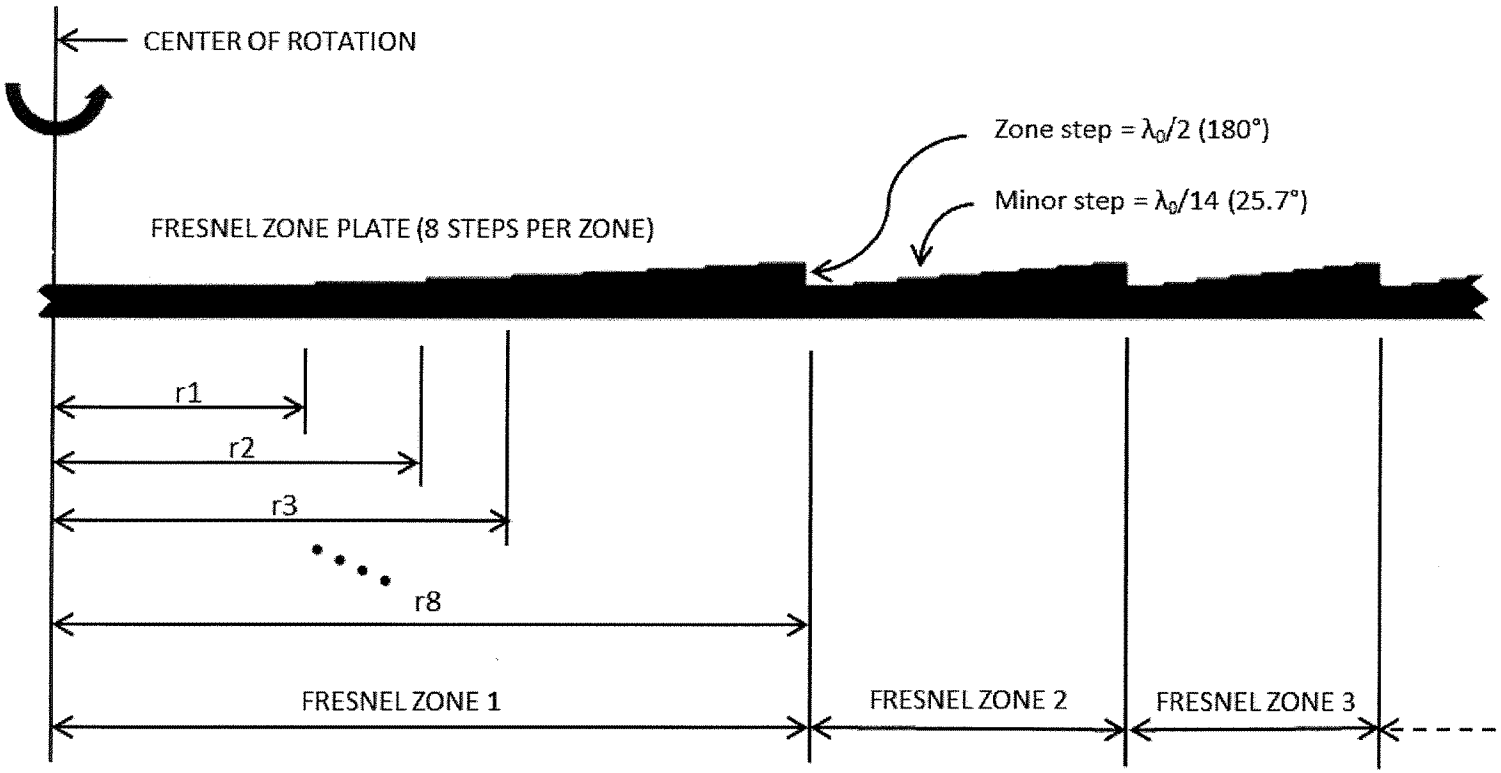
FIG. 2 is the cross-section view of the FZP in FIG. 1.

FIG. 2 is the cross-section view of the FZP in FIG. 1. The cross-section view details how each zone is divided into 8 steps of increasing height moving away from the center of the antenna. To create the Fresnel zone steps, the design equation as is known in the art is used. The equation is as follows for the reflector case (not the lens case):

$$R_n=\{(2nF\lambda_0/P)(n\lambda_0/P)^2\}^{1/2} \quad \text{\{Equation 1\}}$$

Where:

$n=n^{th}$ minor ring $R_n=n^{th}$ minor ring step starting radius

F=Focal distance (distance from center of FZP to phase center of feed horn, meters)

$\lambda_0$=Wavelength at center frequency of design (meters)

P=4 (for reflector case with $\lambda/4$ major phase step)

2 (for lens case with $\lambda/2$ major phase step)

To calculate the number of ring steps needed for a given design, equation 1 can be rearranged to solve for the ring number n for the outer radius of the FZP design. The solution is the positive root of a quadratic equation given as:

$$n_{required}=-8F/\lambda_0+\{(8F/\lambda_0)^2+64(r_{outer}/\lambda_0)^2\}^{1/2} \quad \text{\{Equation 2\}}$$

Where:

$r_{outer}$=Outer radius of the FZP

Example Design 1-meter diameter FZP centered at 11.95 GHz with a focal length of 0.75 meters. $N_{required}$=48.26 (round up to 49) ring steps. Given that there are 8 rings per Fresnel zone, the number of Fresnel zones is 48.26/8≈6.0.

The last parameter that is needed is the height of the $n^{th}$ ring step. Since there are 8 step levels in each Fresnel zone, there are 7 step increments to achieve 8 levels. Each Fresnel zone increases in step height until the major phase step $\lambda_0/2$ is reached at the $8^{th}$ ring. After this ring, the next ring height resets to zero and the steps sequence repeats for next Fresnel zone. The step increment is therefore:

$$\Delta\text{step}=\lambda_0/2/7=\lambda_0/14 \quad \text{\{Equation 3\}}$$

For example, at 11.95 GHz, $\lambda_0$ is 0.02508 m (~25 mm) and Δ step is 0.003584 m (3.584 mm).

Figure 3:
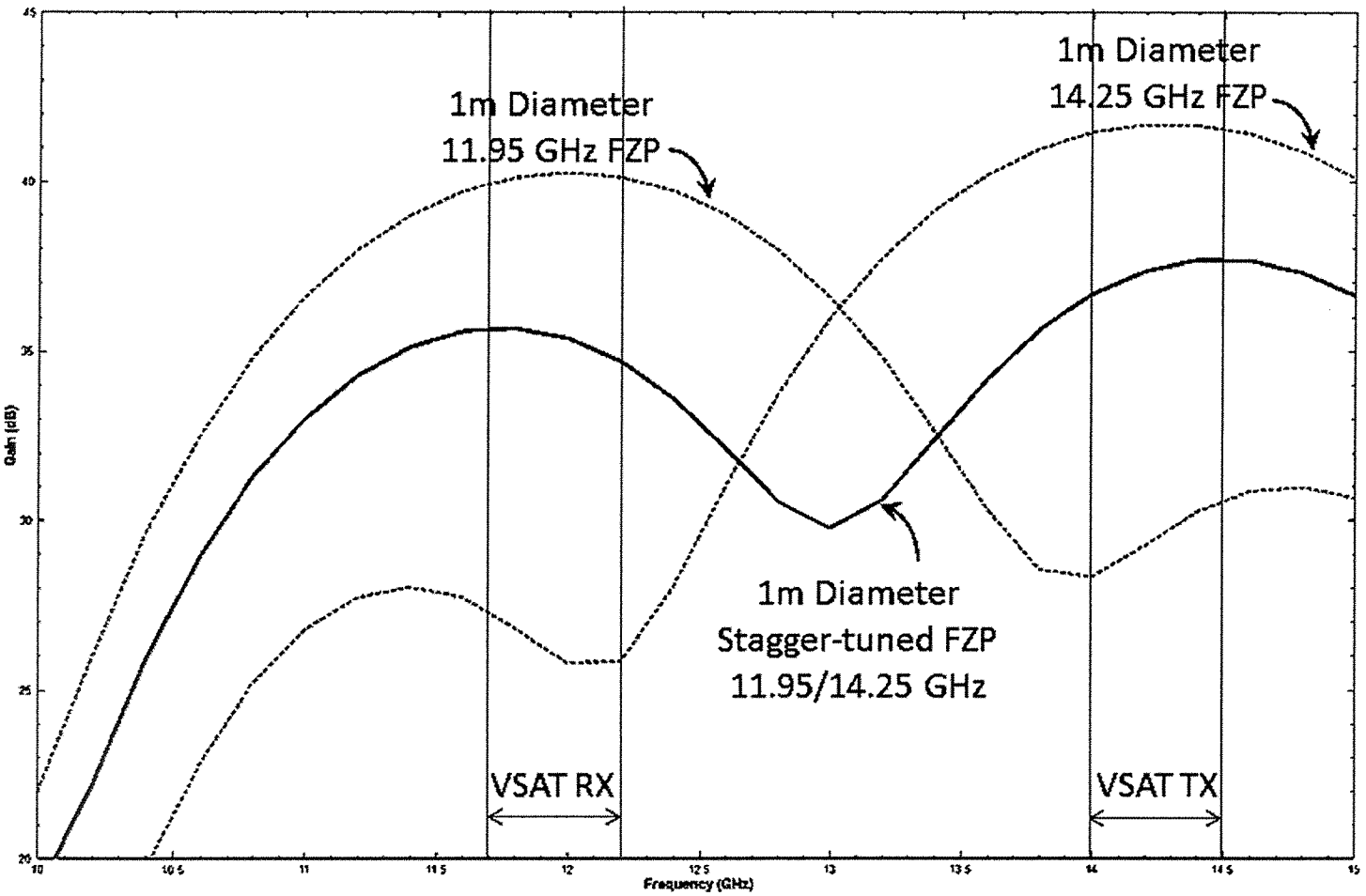
FIG. 3 is a graph of the directivity (dB) as a function of frequency (GHz), applying the implementation in FIG. 1.

FIG. 3 is a graph of the directivity (dB) as a function of frequency (GHz), applying the implementation in FIG. 1. The frequency response of the 2-band stagger tuned FZP reflector plate is shown for a 50%-50% distribution of LOW and HIGH sections by area. It is compared to the single-tuned 11.95 and 14.25 GHz designs. The modeled gain drop is a bit over 4 dB. A 1.5 dB increase is expected with a better feed horn. Likewise, doubling the antenna surface area is expected to increase the bandwidth by 3 dB. Different numbers of "pie" pieces are expected to achieve the same results (4, 6, 8, 9, 12, etc.).

Figure 4:
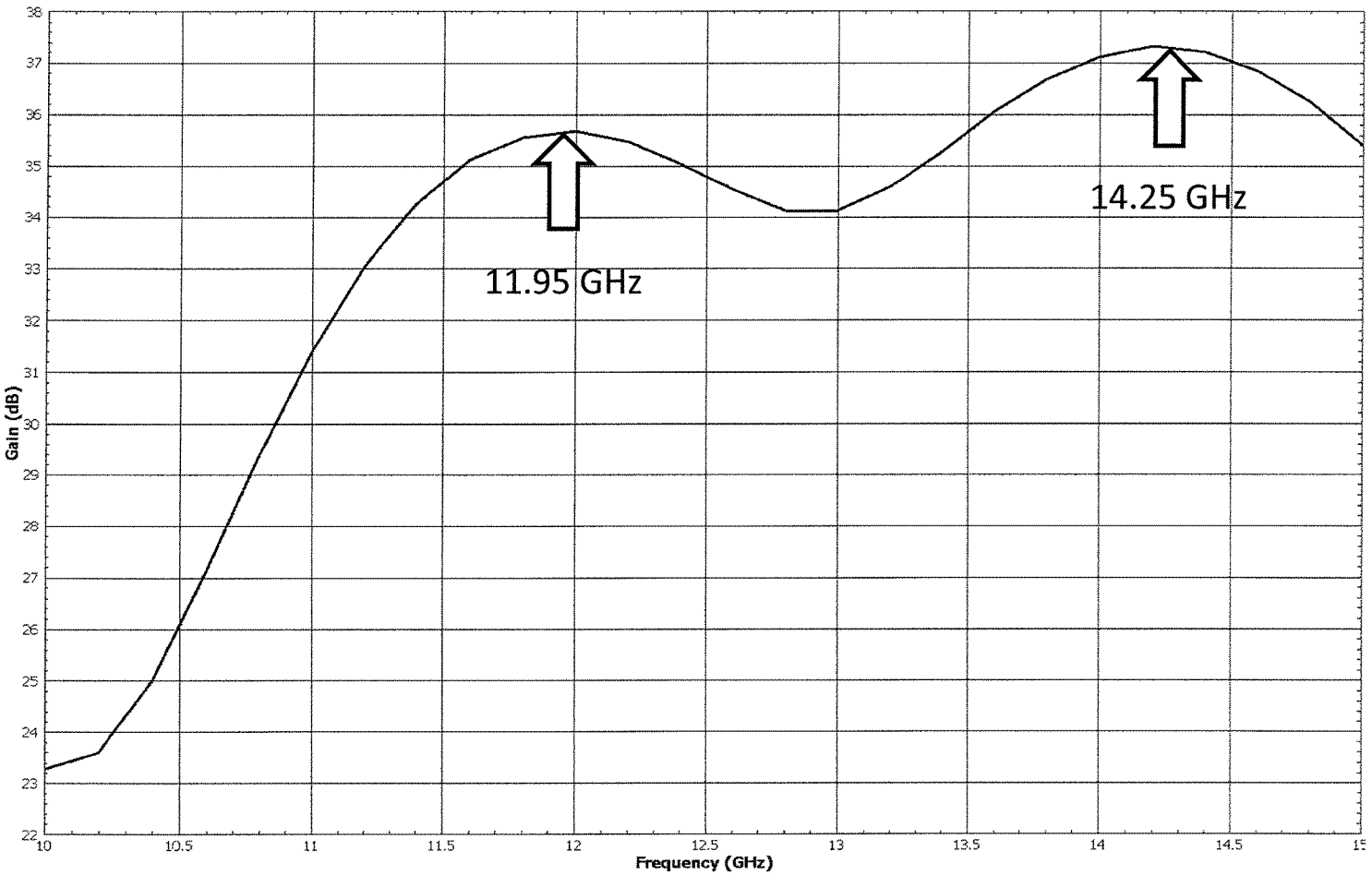
FIG. 4 is another graph applying the implementation in FIG. 1. The graph shows the correction of the FZP design center frequencies by the original error, to restore the gain peaks to the correct frequencies.

FIG. 4 shows the correction of the FZP design center frequencies by the original error to restore the gain peaks to the correct frequencies. This is an artifact of the combined response of both designs in a single reflector. By moving the design centers (11.96 GHz and 14.25 GHz) by the same amount (1.6%) to 12.14 GHz and 14.03 GHz, the gain peaks are now centered correctly at 11.95 GHz and 14.25 GHz. The amount of correction required is determined by the separation between the desired gain peaks.

Although the results from the implementation of the preferred embodiment in FIG. 1 use the design-centered value of ring radii and ring step height, it is possible to independently perturb one or the other to further affect changes in the frequency response shape of the stagger-tuned FZP.

Although the preferred embodiment consists of two frequency channels, three or more channels can be implemented with this method (multiple-tuned design) with a corresponding drop in gain per the allocation of the FZP aperture at each frequency band.

Figure 5:
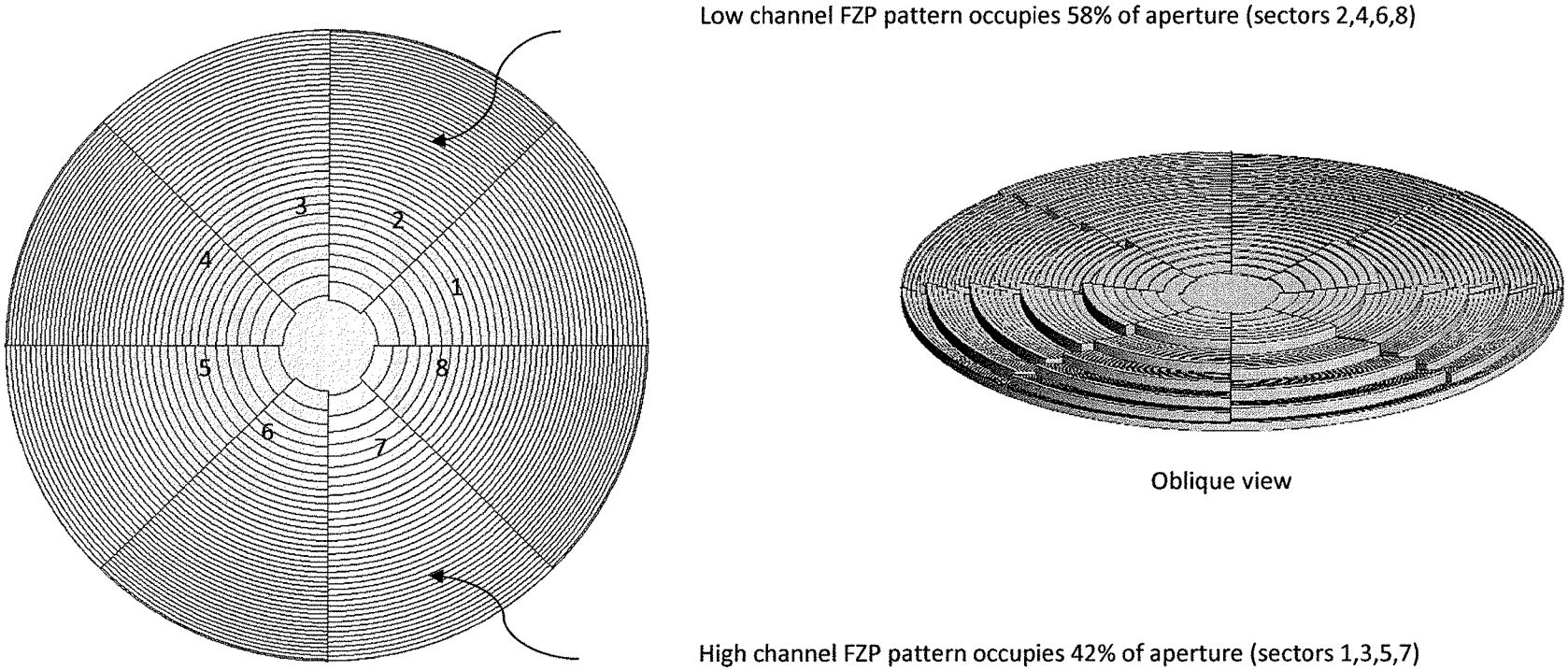
FIG. 5 is a diagram of an alternate embodiment of the present invention, a multiple-tuned VSAT design with the low channel FZP pattern occupying 58% of the antenna aperture, and the high channel FZP pattern occupying the remaining 42% of the antenna aperture.

FIG. 5 is a diagram of an alternate embodiment of the present invention, a multiple-tuned VSAT design with the low channel FZP pattern occupying 58% of the antenna aperture, and the high channel FZP pattern occupying the remaining 42% of the antenna aperture. With this VSAT design, the gain peaks of TX and RX bands favor the TX portion because the bandwidth gain of an antenna with a fixed area increases with frequency. To balance TX and RX gain values, the proportion of FZP aperture allocated to the hi/low frequencies is changed from 50%-50% to 42%-58%. Therefore, the pie pieces of 12 GHz FZP are increased from 45-degrees to 52.2-degrees, and the pie pieces of the 14 GHz FZP are decreased from 45-degrees to 37.8-degrees. The gain of different band segments in a multiple-tuned FZP design can be tailored by altering the relative area occupied by each FZP section.

For the VSAT design in FIG. 5, a split-tuned design is used to accommodate TX and RX band segments. It is believed that the split tuning proportion can be decreased to merge the gain peaks from two distinct channels into one wide channel. In this way, if coverage is needed for a single band with a bandwidth greater than 9%, a dual-tuned approach can be used to increase the bandwidth of a single-tuned FZP reflector.

Figure 6:
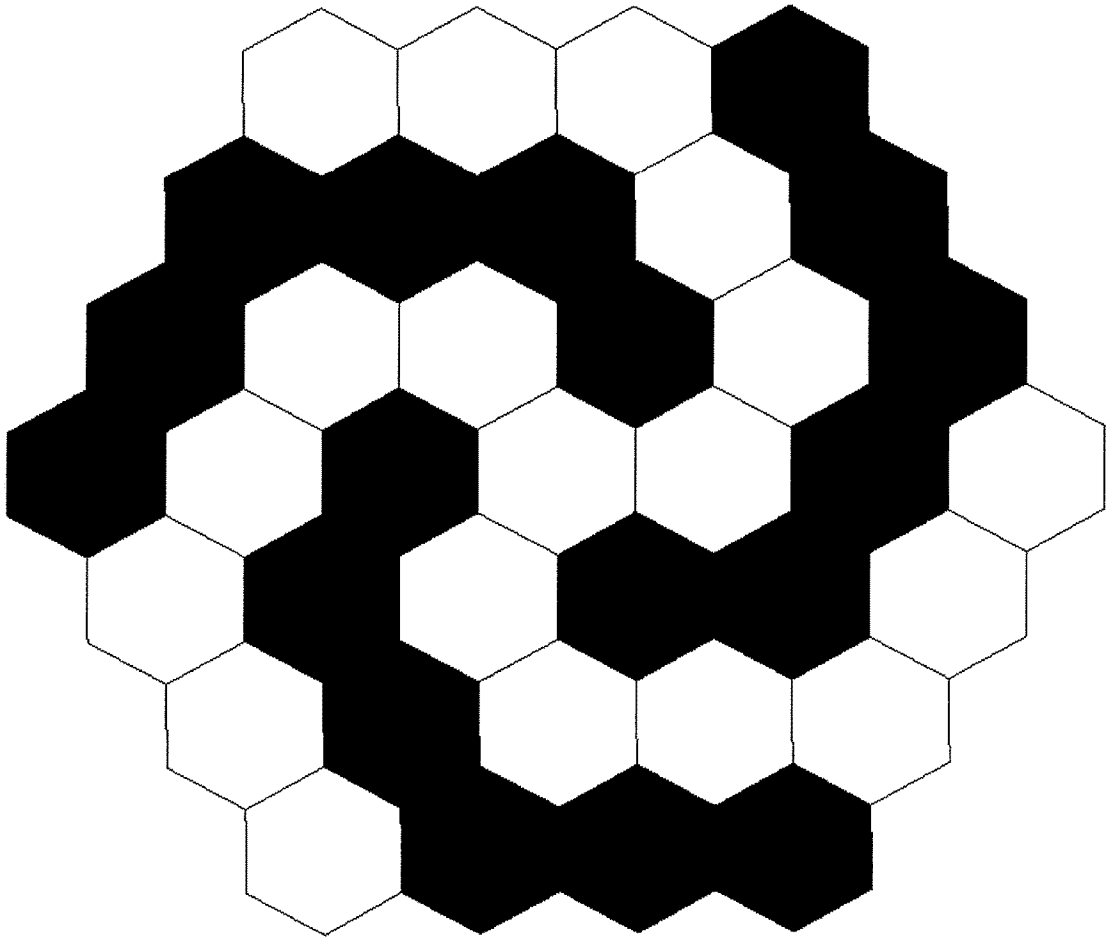
FIG. 6 is a diagram of an alternate embodiment of the present invention, a hexagonal implementation of a dual-tuned FZP reflector.

FIG. 6 is a diagram of an alternate embodiment of the present invention, a hexagonal implementation of a dual-tuned FZP reflector. Other geometric means of dividing the surface area can also be employed. It is by no means limited to pie-shaped segments, nor limited to a perfect circular outline. The criteria for sub-dividing the reflector area is this: for any given radius out from the epi-focus point (center of reflector), there should be an almost equal amount of area devoted to each frequency sub-band. In FIG. 6, there are 37 hexagons, the white ones are frequency 1, and the black ones are frequency 2. The odd hexagon in the middle can be assigned to either frequency as it is mostly a singular flat surface being the inner most Fresnel zone.

An alternate embodiment can be considered other than stagger-tuning two FZP designs into distinct regions. The zone radii defined in Equation 1 can be modulated against rotational angle to periodically vary the FZP center frequency. The result would appear as a wiggled zone pattern instead of circular zones of fixed radii. The same rules off symmetry apply: the number of wiggles per rotation should be 6 or greater.

Figure 7:
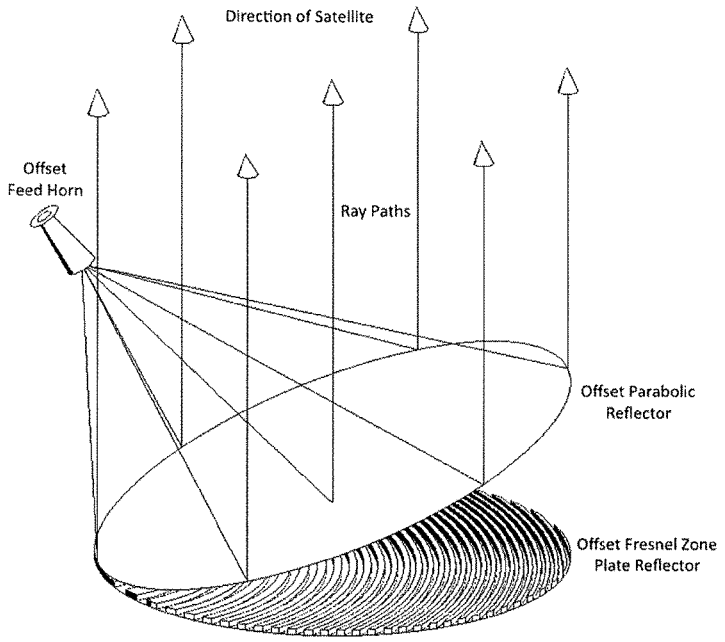
FIG. 7 is a diagram of an alternate embodiment of the present invention, a singly-tuned FZP design with an offset feedhorn, offset parabolic reflector, and offset FZP reflector.
Figure 7:
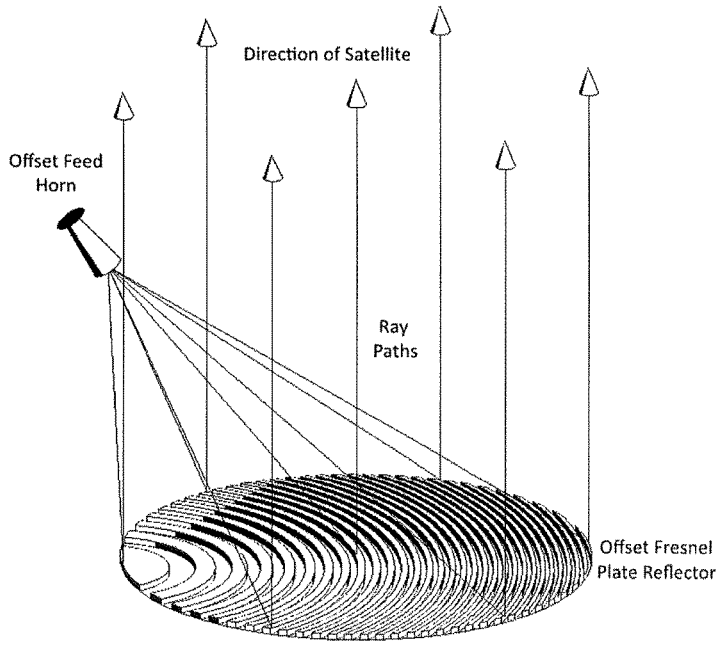

FIG. 7 is a diagram of an alternate embodiment of the present invention, a single-tuned FZP design with an offset feed horn, and offset FZP reflector. Many commercial satellite antennas employ what is referred to as offset feed designs (as opposed to prime focus). The advantage of an offset feed horn is two-fold: (a) the feed horn does not block the incoming signal, which reduces the gain slightly; and (b) the sidelobes of the feed horn pattern that extend beyond the edges of the reflector are looking at cold space (~3° Kelvin) instead of warm ground (~290° K). Any matter above absolute zero (0° K) emits what is known as black body noise. Satellite receive signals are usually quite low in power so it is desired that extraneous noise energy be minimized. Less black body noise is coupled into the offset feed horn, thus improving signal-to noise ratio of the incoming signal as well as the G/T rating of the system. The same method of emulating a parabolic dish using a Fresnel zone flat plate also applies to offset-feed configurations.

Figure 8:
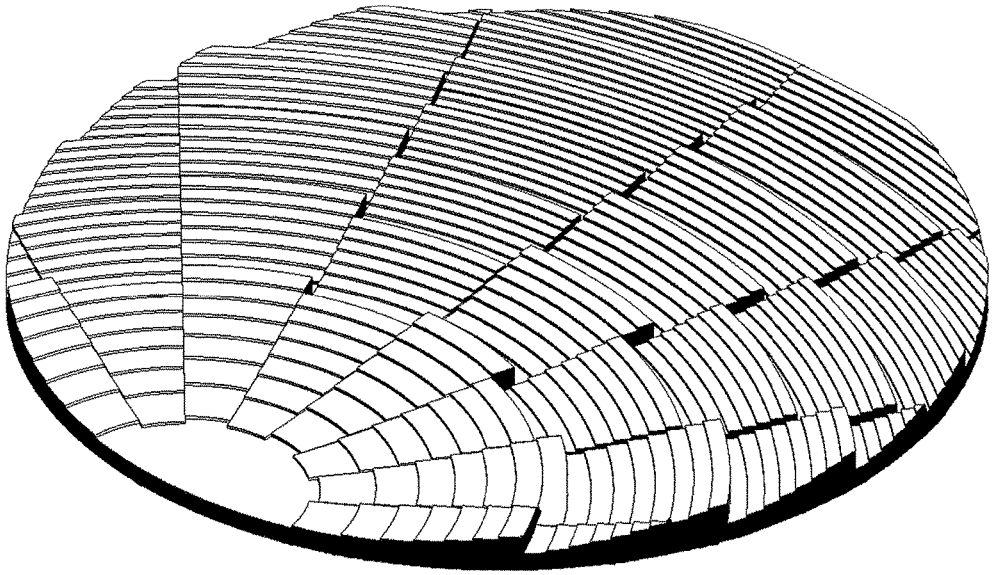
FIG. 8 is a diagram of an alternate embodiment of the present invention, a dual-tuned offset feed 8-step FZP reflector.

FIG. 8 is a diagram of an alternate embodiment with a dual-tuned offset feed 8-step FZP reflector.

Figure 9:
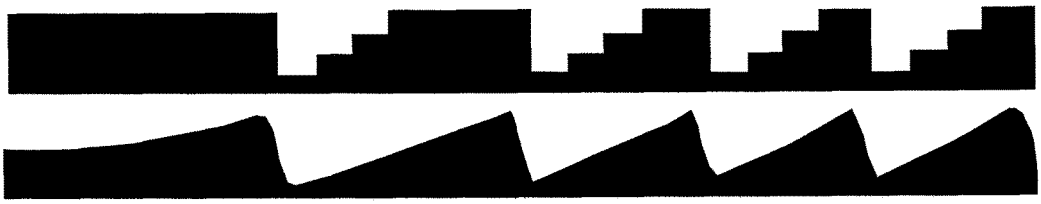
FIG. 9 is a schematic profile of an alternate embodiment of the present invention exchanging the 8-step FZP pattern with a parabolic Fresnel pattern.

FIG. 9 is a schematic profile of an alternate embodiment that uses the approach of exchanging the 8-step FZP pattern with a parabolic Fresnel pattern. The thickness of the reflector increases with this approach to potentially 2 inches, increasing the size of the folded embodiment to a range of 2-4 tissue boxes. A bandwidth of 17.6% is expected at 1 dB and a bandwidth of 32.2% is expected at 3 dB. Increasing the surface area will increase the gain, as will using stagger-tuning.

While the principles of the disclosure have been described above in connection with specific methods, it is to be clearly understood that this description is made only by way of example and not as limitation on the scope of the disclosure. Whether now known or later discovered, there are countless other alternatives, variations and modifications of the many features of the various described and illustrated embodiments, both in the process and in the device characteristics, that will be evident to those of skill in the art after careful and discerning review of the foregoing descriptions, particularly if they are also able to review all of the various systems and methods that have been tried in the public domain or otherwise described in the prior art. All such alternatives, variations and modifications are contemplated to fall within the scope of the present invention.

Although the present invention has been described in terms of the foregoing preferred and alternative embodiments, these descriptions and embodiments have been provided by way of explanation of examples only, in order to facilitate understanding of the present invention. As such, the descriptions and embodiments are not to be construed as limiting the present invention, the scope of which is limited only by the claims of this and any related patent applications and any amendments thereto. With reference again to the figures, it should be understood that the graphical representation of the system is an exemplary reference to any number of devices that may be implemented by the present invention.

What is claimed is:

1. A dual tuned, portable, storable, Ku-band very small aperture terminal antenna for transmitting to and receiving from a satellite comprising:

a flat antenna reflector that includes a plurality of discrete physical subsections comprising a first set of discrete physical subsections and a second set of discrete physical subsections; and a feed horn, wherein the flat antenna reflector is able to be disassembled into a disassembled flat antenna reflector, wherein the discrete physical subsections disassemble and stack to reduce storage volume, and the flat antenna reflector is assembled into an assembled flat antenna reflector, the assembled flat antenna reflector comprising a first Fresnel zoneplate pattern (FZP) formed by the first set of discrete physical subsections centered at a first frequency and a second FZP centered formed by the second set of discrete physical subsections at a second frequency different from the first frequency.

2. The antenna of claim 1, wherein the first FZP and the second FZP comprise a number of pie-shaped zones.

3. The antenna of claim 2, wherein a center of the pie-shaped zones is disposed at a center of the assembled flat antenna reflector, and the feed horn is centered relative to the assembled flat antenna reflector no matter the rotational orientation of the assembled flat antenna reflector.

4. The antenna of claim 3, wherein:

the number of pie-shaped zones is 8, each of the 8 pie-shaped zones is 45 degrees, and the pie-shaped zones alternate in a radial pattern between the first FZP and the second FZP.

5. The antenna of claim 2, wherein a center of the pie-shaped zones is disposed offset from a center of the assembled flat antenna reflector, and the feed horn is offset from the center of the assembled flat antenna reflector.

6. The antenna of claim 1, wherein the first FZP and the second FZP comprise a number of hexagonal sections.

7. The antenna of claim 6, wherein a center of the hexagonal sections is disposed at a center of the assembled flat antenna reflector, and the feed horn is centered relative to the assembled flat antenna reflector no matter the rotational orientation of the assembled flat antenna reflector.

8. The antenna of claim 7, wherein the number of hexagonal sections is 37, and the hexagonal sections alternate in a radial pattern between the first FZP and the second FZP.

9. The antenna of claim 1, wherein the feed horn is centered relative to the assembled flat antenna reflector no matter the rotational orientation of the assembled flat antenna reflector.

10. The antenna of claim 1, wherein the feed horn is offset from the center of the assembled flat antenna reflector.

11. The antenna of claim 1, wherein a total area of the assembled flat antenna reflector is divided equally between the first FZP and the second FZP.

12. The antenna of claim 1, wherein a total area of the assembled flat antenna reflector is divided unequally between the first FZP and the second FZP.

13. The antenna of claim 12, wherein

58% of the total area is the first FZP, and

42% of the total area is the second FZP.

14. The antenna of claim 1, wherein the first frequency is one frequency from the group consisting of 11.95 GHz and 14.25 GHz, and the second frequency is another, different frequency from the group consisting of 11.95 GHz and 14.25 GHz.

* * * * *